US011105585B2

(12) United States Patent
Lecosnier et al.

(10) Patent No.: US 11,105,585 B2
(45) Date of Patent: Aug. 31, 2021

(54) IDENTIFICATION DEVICE FOR ATTACHMENT TO HOLSTER

(71) Applicant: BLACK BUNKER ApS, Espergaerde (DK)

(72) Inventors: Romain Lecosnier, Espergaerd (DK); Tamir Porat, Tel Aviv (IL)

(73) Assignee: BLACK BUNKER APS, Espergaerde (DK)

( * ) Notice: Subject to any disclaimer, the term of this patent is extended or adjusted under 35 U.S.C. 154(b) by 6 days.

(21) Appl. No.: 16/362,490

(22) Filed: Mar. 22, 2019

(65) Prior Publication Data

US 2019/0331456 A1 Oct. 31, 2019

Related U.S. Application Data

(60) Provisional application No. 62/620,986, filed on Jan. 23, 2018.

(51) Int. Cl.
*F41C 33/04* (2006.01)
*A45F 5/02* (2006.01)

(52) U.S. Cl.
CPC ..... *F41C 33/045* (2013.01); *A45F 5/021* (2013.01); *A45F 2200/0591* (2013.01)

(58) Field of Classification Search
CPC .... F41C 33/045; F41C 33/04; F41C 33/0254; F41C 33/02; A45F 5/021; A45F 2200/0591
See application file for complete search history.

(56) References Cited

U.S. PATENT DOCUMENTS

2011/0174847 A1* 7/2011 Crye ..... F41C 33/0236 224/243
2012/0085013 A1* 4/2012 Cahill ..... F41C 27/00 42/96
2020/0116455 A1* 4/2020 Haggart ..... F42B 39/02

* cited by examiner

*Primary Examiner* — Corey N Skurdal
(74) *Attorney, Agent, or Firm* — Ferguson Case Orr Paterson

(57) ABSTRACT

Described herein are holster identification devices for attachment to a holster designed to carry another object, such as a weapon or firearm. The holster identification device can include an area where a user can attach identification such as a badge. The identification can be permanently attached or can be removably attached, such as using hook-and-loop fasteners. The device can be designed to snap-fit onto a holster, such as using two side portions designed to wrap around at least a portion of the holster to provide a snug fit. The frontside of the holster and the backside of the holster identification device can include complementary protrusions/indentations or male/female parts to help ensure a secure connection.

2 Claims, 21 Drawing Sheets

FIG. 15A
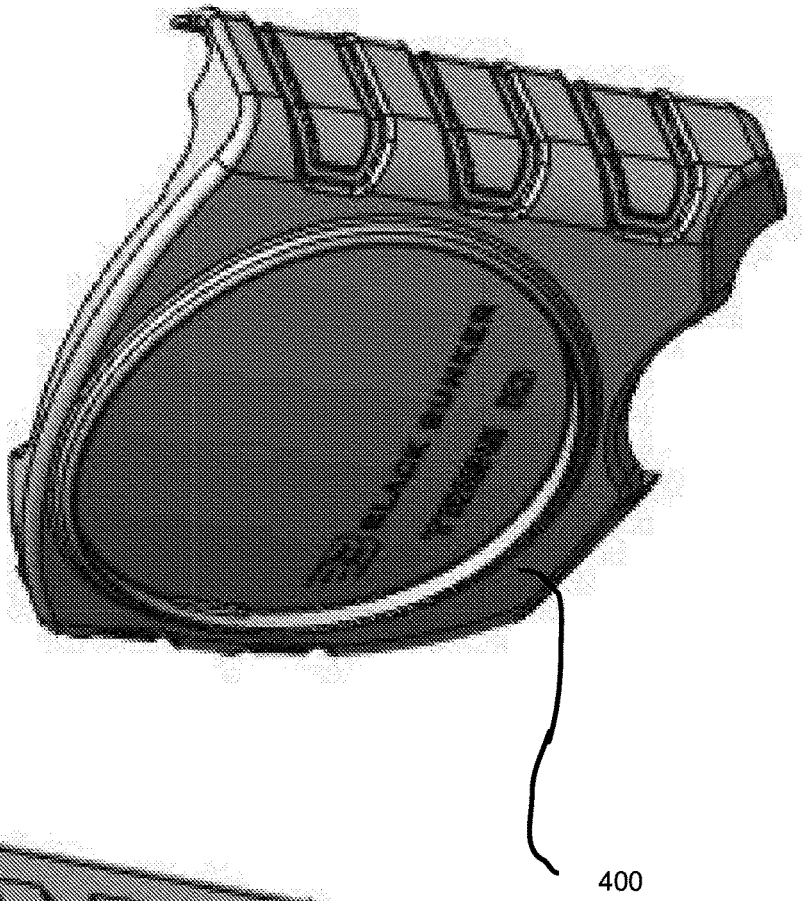
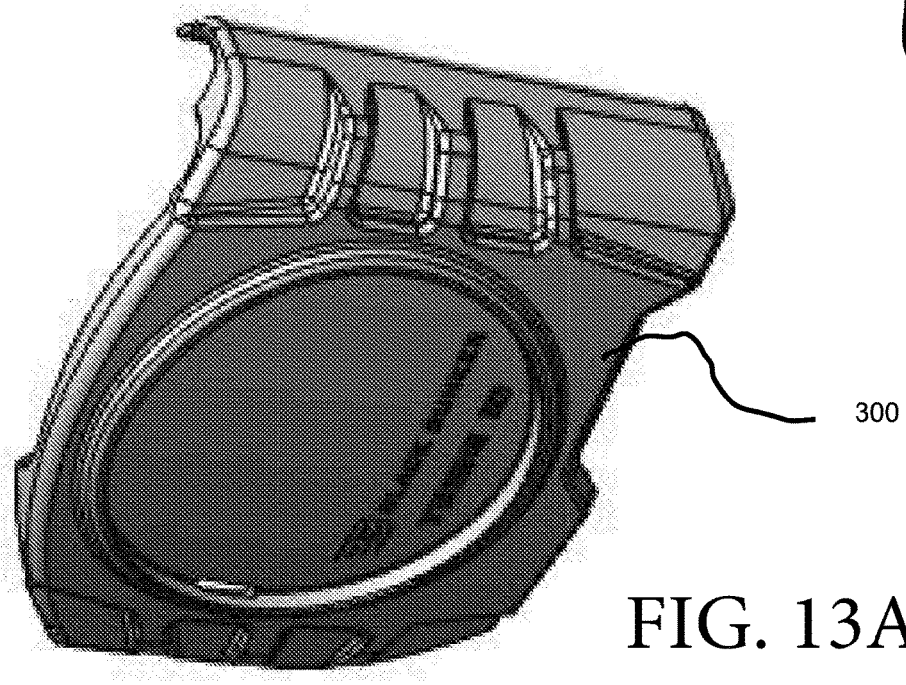
FIG. 13A

FIG. 13B
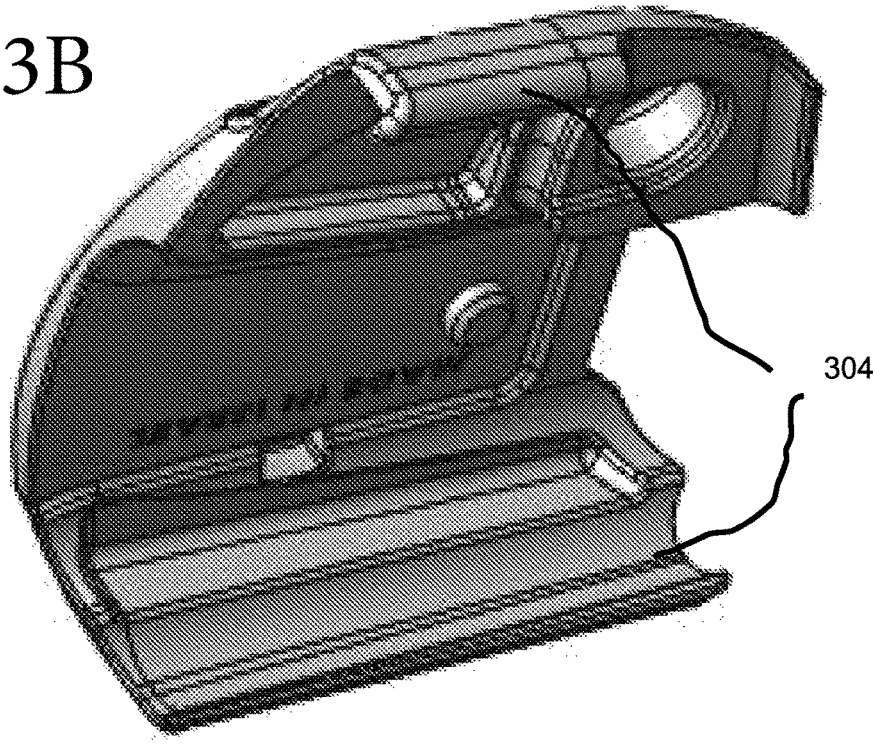
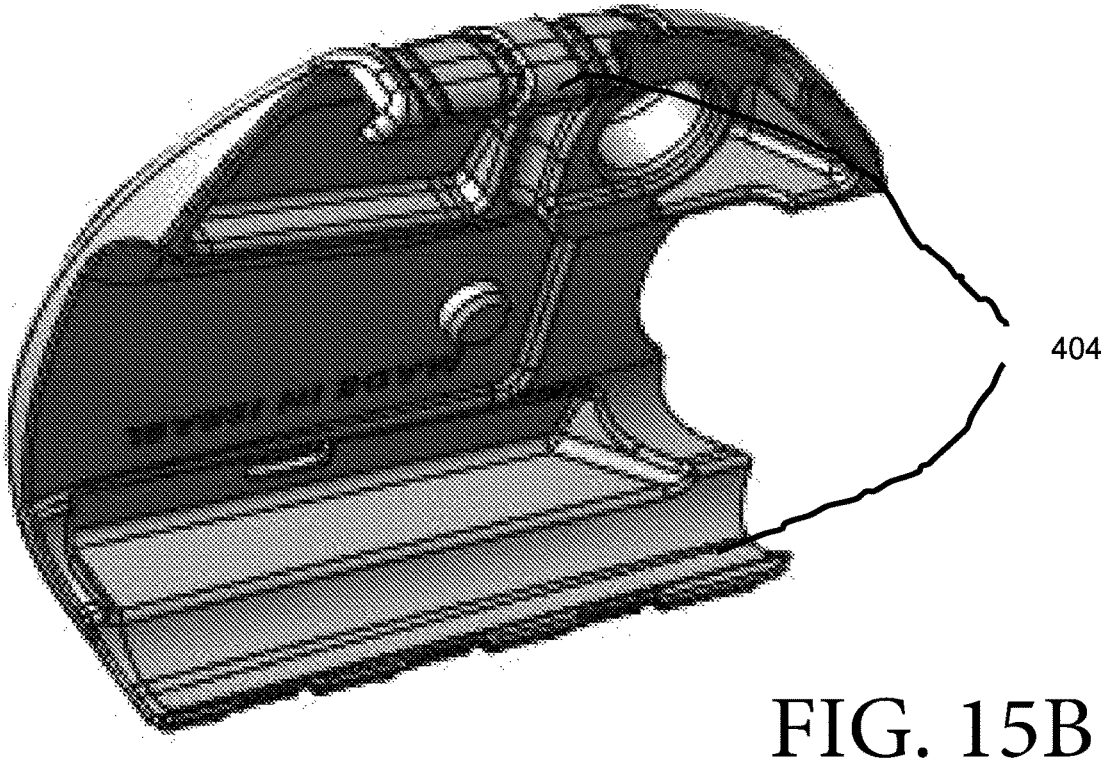
FIG. 15B

400

300

300

400

400

300

400

300

300

300

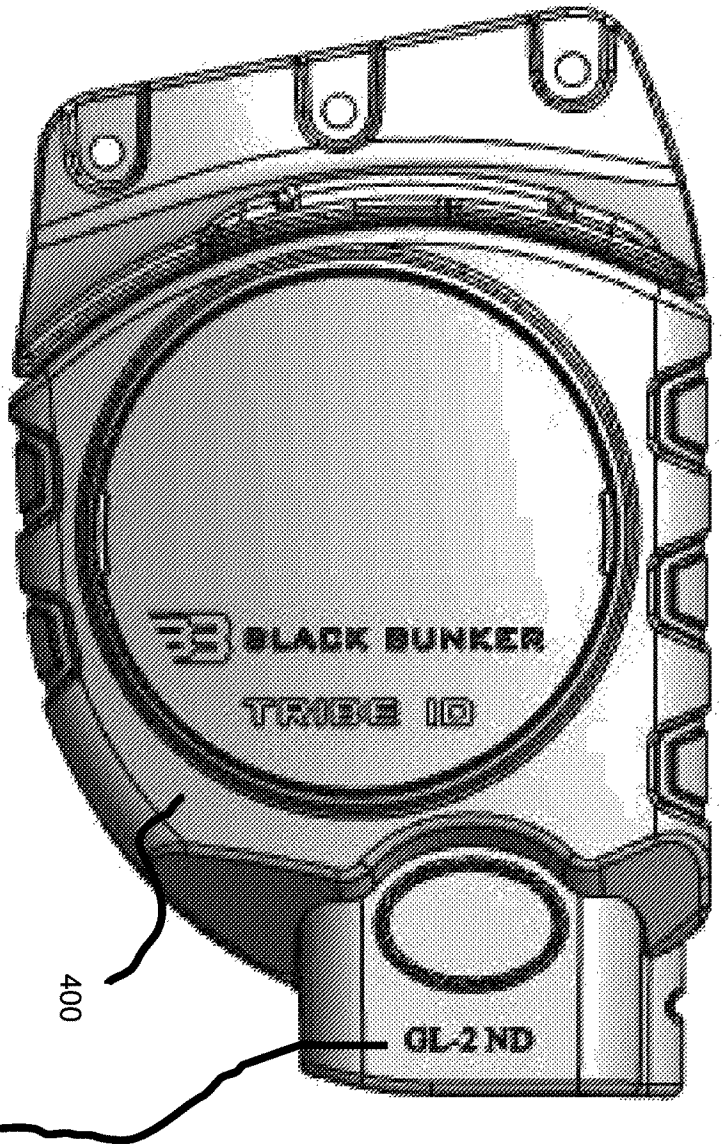
FIG. 16B
FIG. 14B
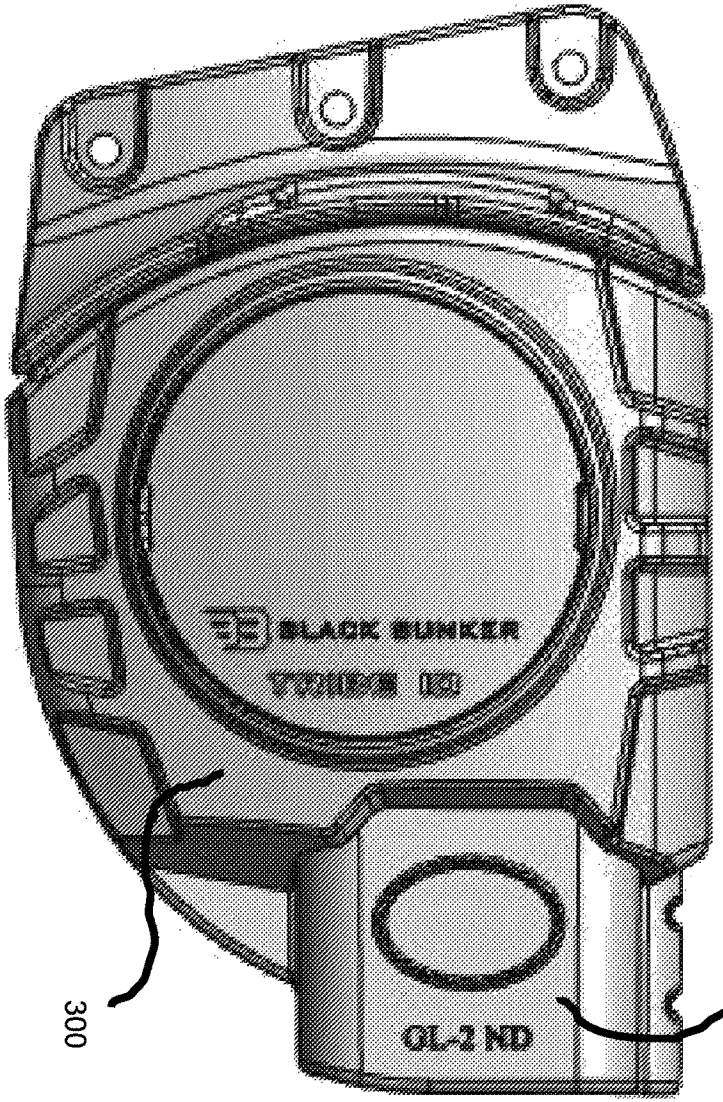

400

400

IDENTIFICATION DEVICE FOR ATTACHMENT TO HOLSTER

The present application claims priority to U.S. Provisional Pat. App. No. 62/620,986, filed on Jan. 23, 2018 and entitled "Identification Device for Attachment to Holster," the entire contents of which are hereby incorporated by reference.

BACKGROUND

1. Field of the Disclosure

The present disclosure relates generally to devices for identification, such as devices that can be attached to a holster.

2. Description of the Related Art

Members of military units, police units, and other groups often wear badges or other identifying information, such as on their uniform. These personnel also often carry their weapons, such as firearms, and particularly handguns, in holsters such as the prior art holster 90 shown in FIG. 1. To date, no efficient, clear, and visually appealing method for wearing identification on a person's weapon holster exists.

BRIEF DESCRIPTION OF THE FIGURES

FIGS. 13A-13H are front perspective, rear perspective, front, rear, top, bottom, side, and opposite side views of a holster identification device according to one embodiment of the present disclosure.

FIGS. 14A and 14B are front perspective and front views of the holster identification device shown in FIGS. 13A-13H in combination with a prior art holster.

FIGS. 15A-15H are front perspective, rear perspective, front, rear, top, bottom, side, and opposite side views of a holster identification device according to one embodiment of the present disclosure.

FIGS. 16A and 16B are front perspective and front views of the holster identification device shown in FIGS. 15A-15H in combination with a prior art holster.

DETAILED DESCRIPTION OF THE DISCLOSURE

Figure 1:
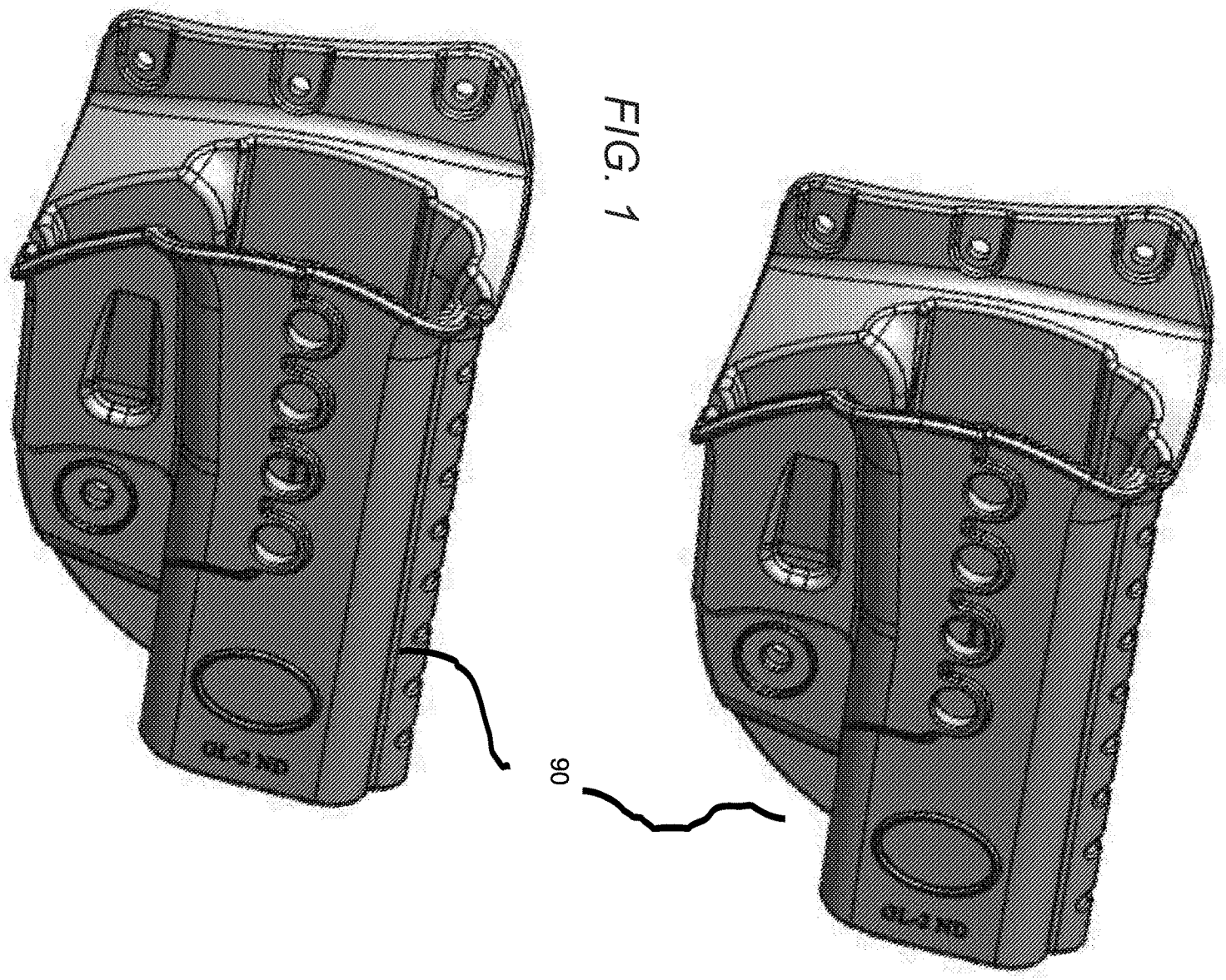
FIG. 1 is a front perspective view of a prior art holster.
Figure 2:
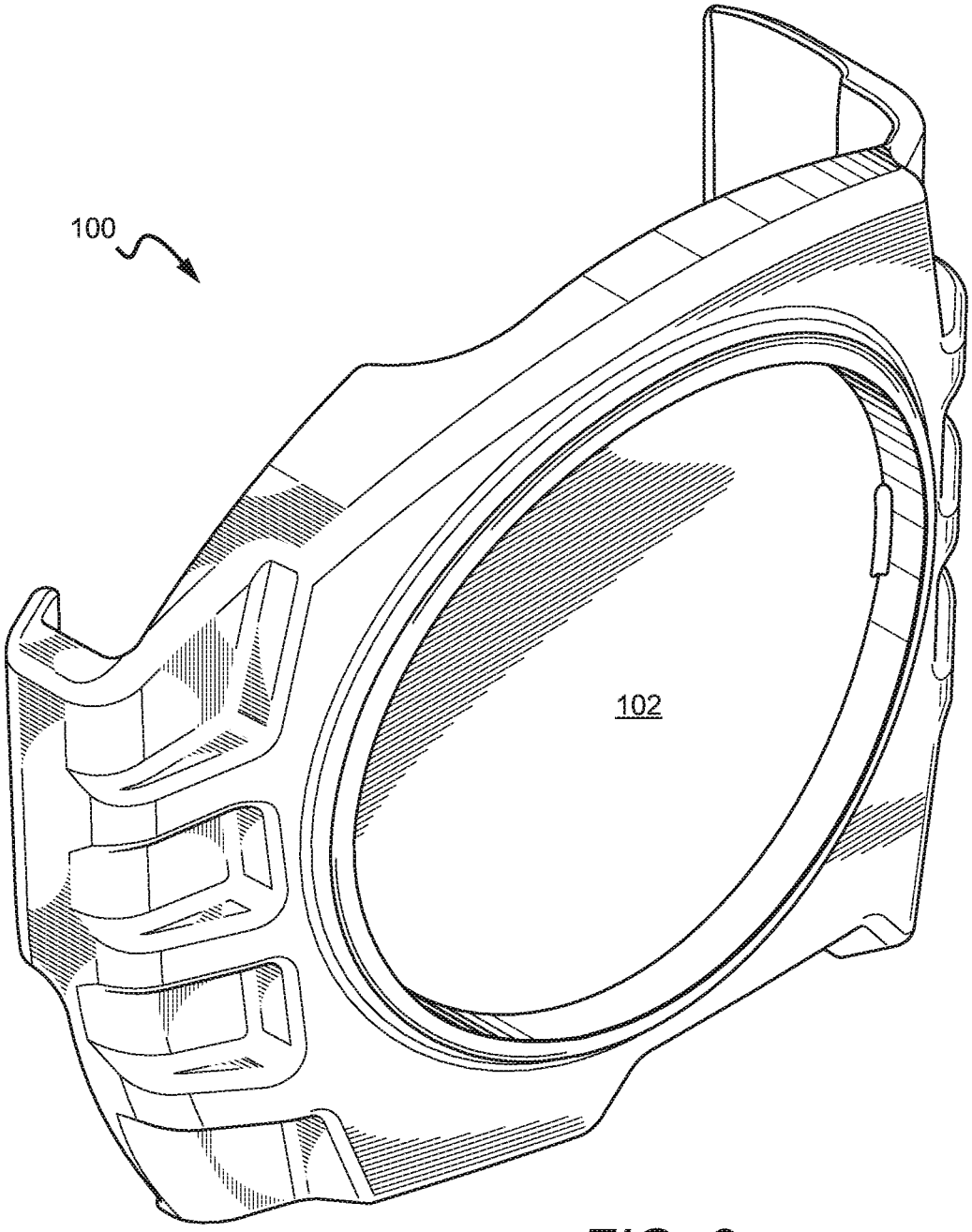
FIG. 2 is a front perspective view of a holster identification device according to one embodiment of the present disclosure.
Figure 5:
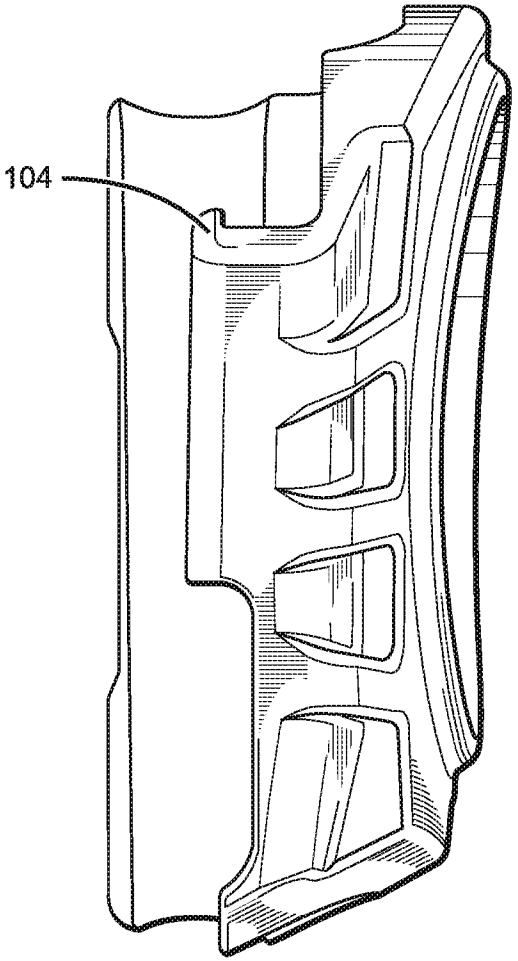
FIG. 5 is a left side view of the holster identification device shown in FIG. 2.
Figure 3:
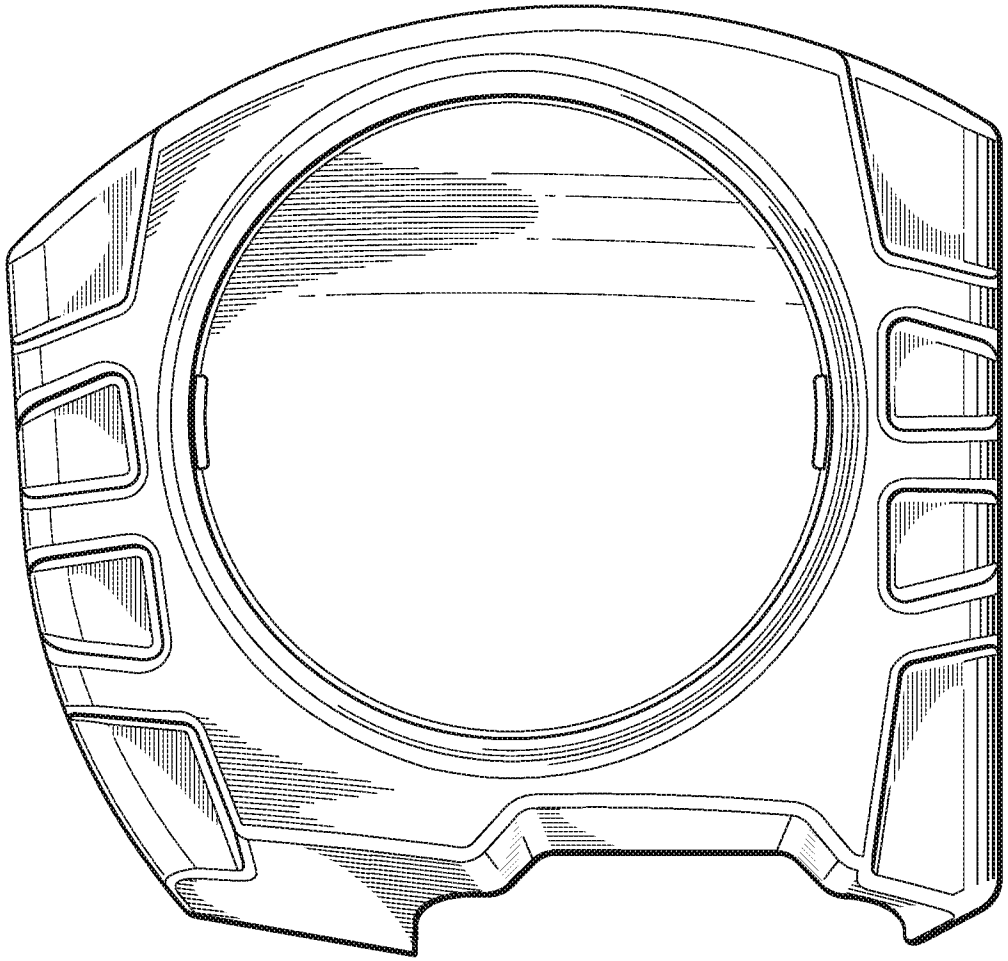
FIG. 3 is a front view of the holster identification device shown in FIG. 2.
Figure 6:
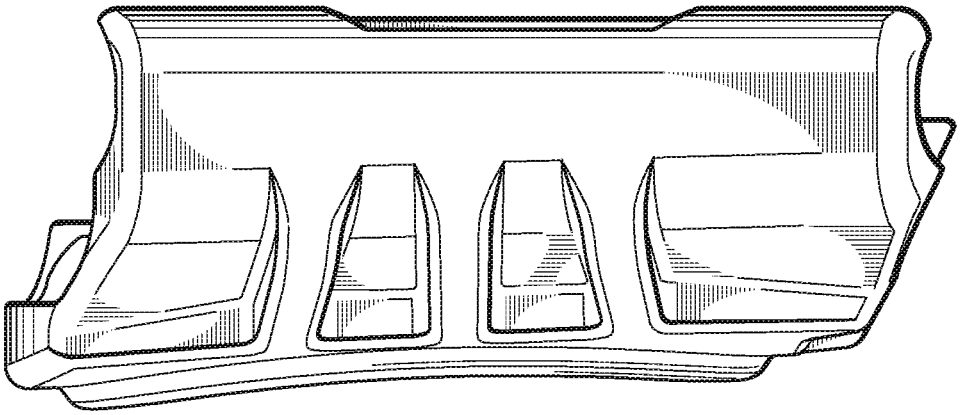
FIG. 6 is a right side view of the holster identification device shown in FIG. 2.
Figure 4:
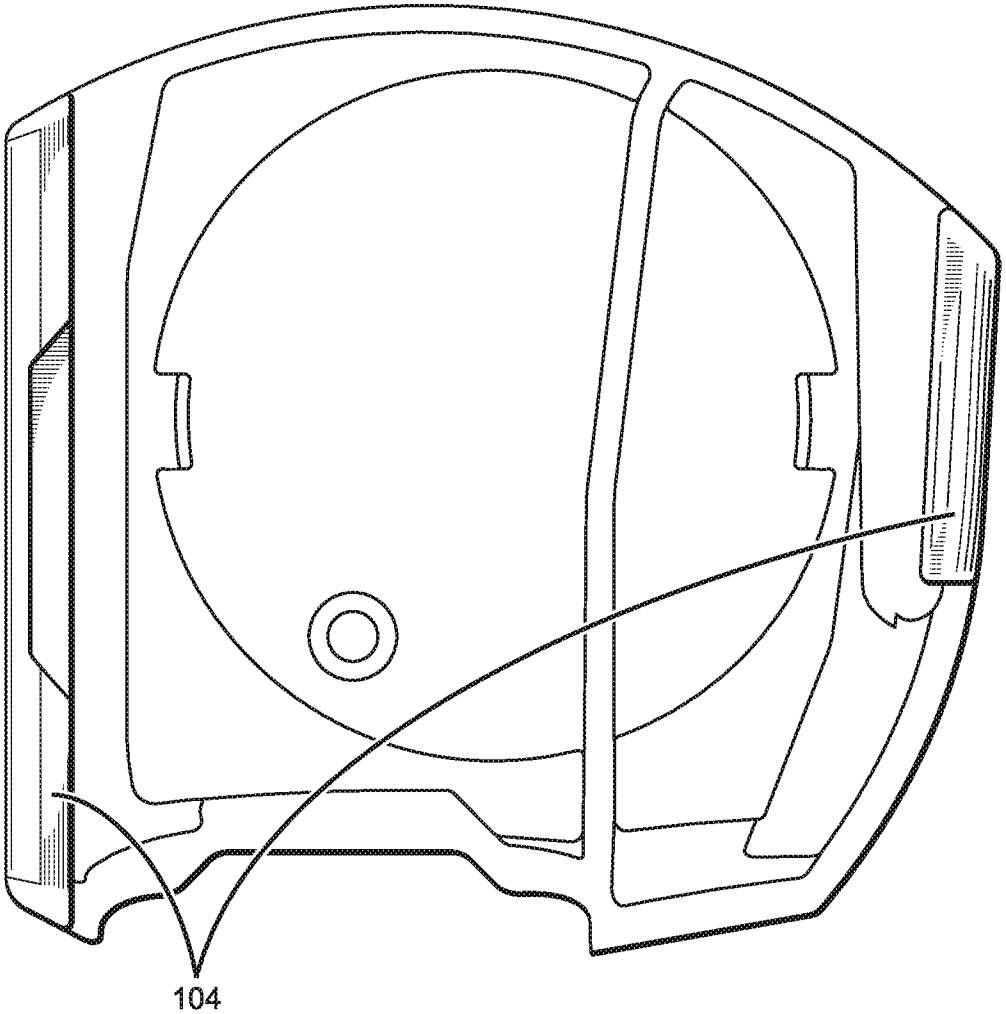
FIG. 4 is a rear view of the holster identification device shown in FIG. 2.
Figure 7:
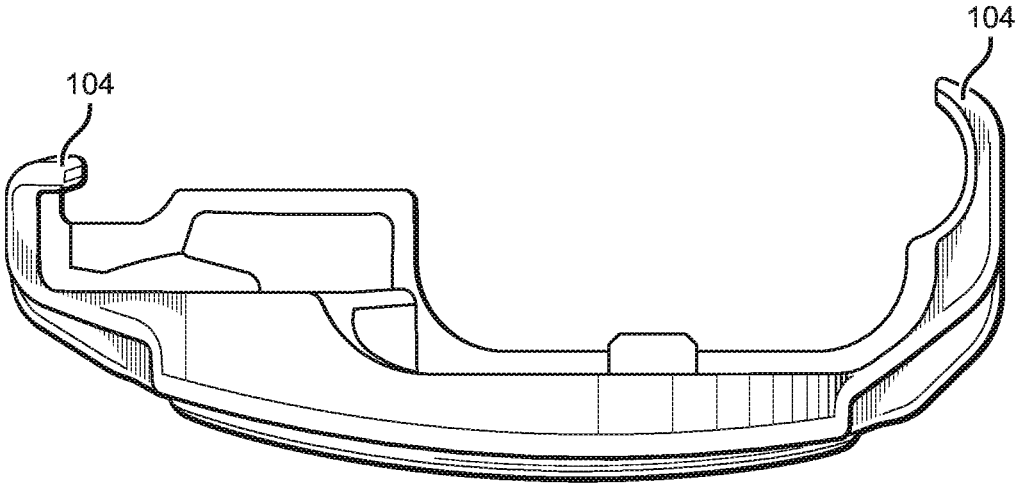
FIG. 7 is a top view of the holster identification device shown in FIG. 2.
Figure 8:
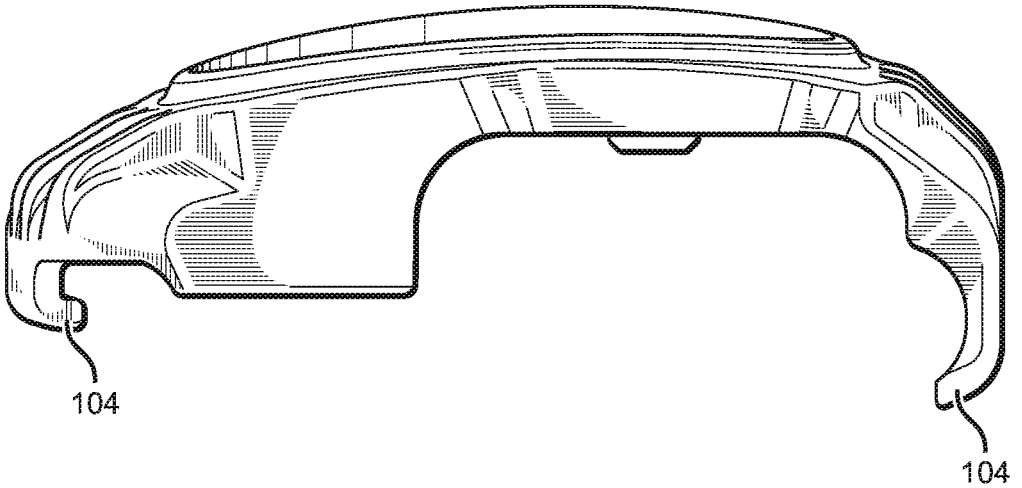
FIG. 8 is a bottom view of the holster identification device shown in FIG. 2.

Described herein are holster identification devices for attachment to a holster designed to carry another object, such as a weapon or firearm. The holster identification device can include an area where a user can attach identification such as a badge. The identification can be permanently attached or can be removably attached, such as using hook-and-loop fasteners. The device can be designed to snap-fit onto a holster, such as using two side portions designed to wrap around at least a portion of the holster to provide a snug fit. The frontside of the holster and the backside of the holster identification device can include complementary protrusions/indentations or male/female parts to help ensure a secure connection.

It is understood that when an element is referred to as being "on" another element, it can be directly on the other element or intervening elements may also be present. Further, when one element is referred to as being "connected" to another element, it can be directly connected to the other element or intervening elements may also be present as would be understood by one of skill in the art. Furthermore, relative terms such as "inner", "outer", "upper", "top", "above", "lower", "bottom", "beneath", "below", and similar terms, may be used herein to describe a relationship of one element to another. Terms such as "higher", "lower", "wider", "narrower", and similar terms, may be used herein to describe angular and/or relative relationships. It is understood that these terms are intended to encompass different orientations of the elements or system in addition to the orientation depicted in the figures.

Although the terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present disclosure.

Embodiments of the disclosure are described herein with reference to view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region and are not intended to limit the scope of the disclosure.

FIGS. 2-8 show a holster identification device 100 according to the present disclosure. The device 100 includes an identification area 102. The identification area 102 can be recessed as shown ("recessed" including, but not limited to, embodiments where the identification area is substantially surrounded by a raised border, and embodiments where the identification area is recessed into the surrounding body of the device), though other embodiments are possible. A recessed identification area can prevent the accidental dislodgment of identification, such as a badge, sticker, etc. from the identification area 102. The identification area 102 can take many different shapes, including a circular shape as shown. Other shapes are possible, including but not limited to regular and irregular polygons, rectangles, squares, triangles, shapes with curves, ovals, etc. The identification area 102 can be on the front of the device 100 (i.e., the surface of the device 100 facing outward from the wearer of the holster).

The device 100 can include portions 104 which wrap around the sides and/or rear of part of a holster device so as to secure the device to a holster, such as via a snap-fit, which will be described more fully below with regard to FIGS. 13A-16B.

Figure 9:
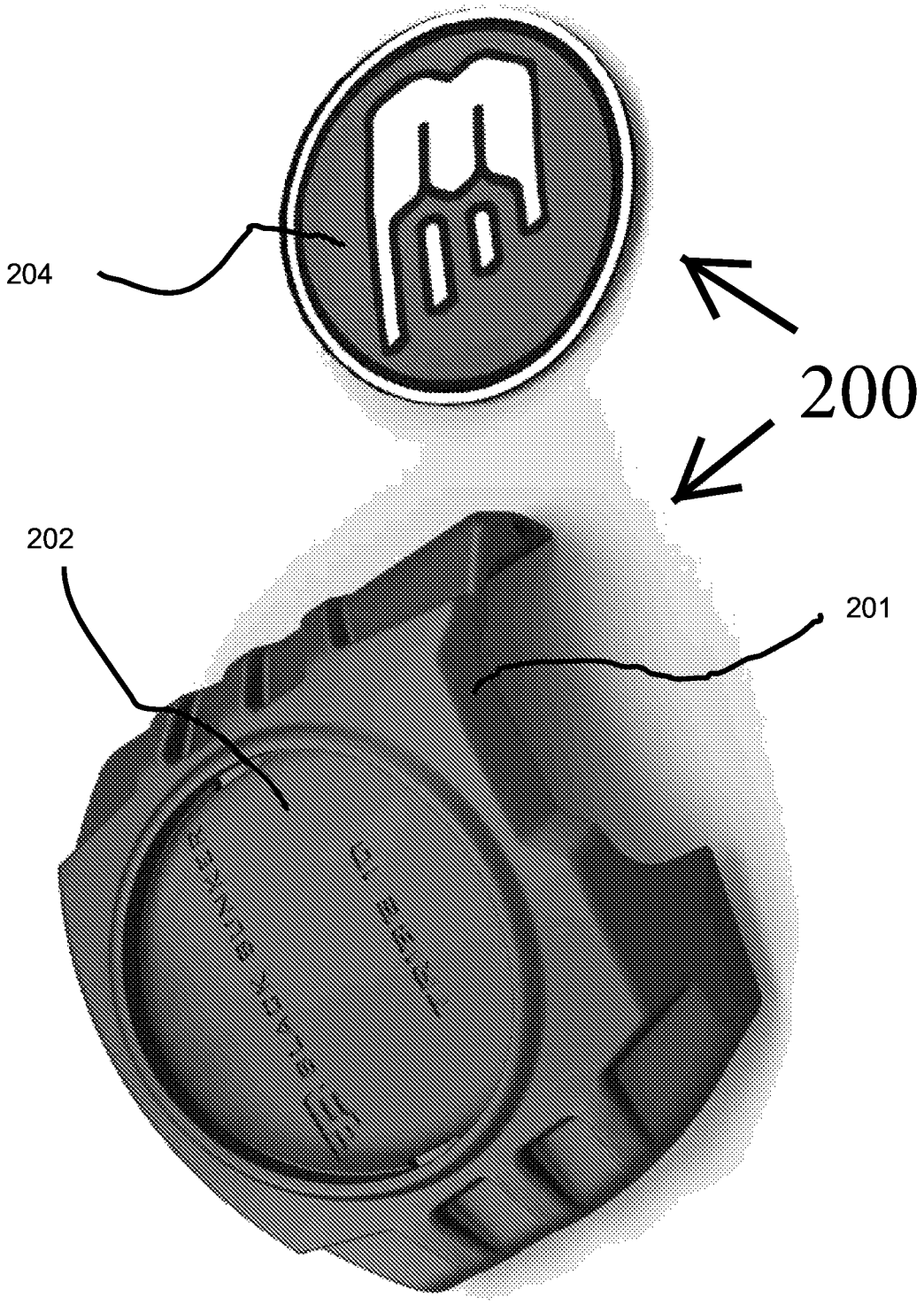
FIG. 9 is an exploded view of a holster identification device according to one embodiment of the present disclosure.
Figure 10:
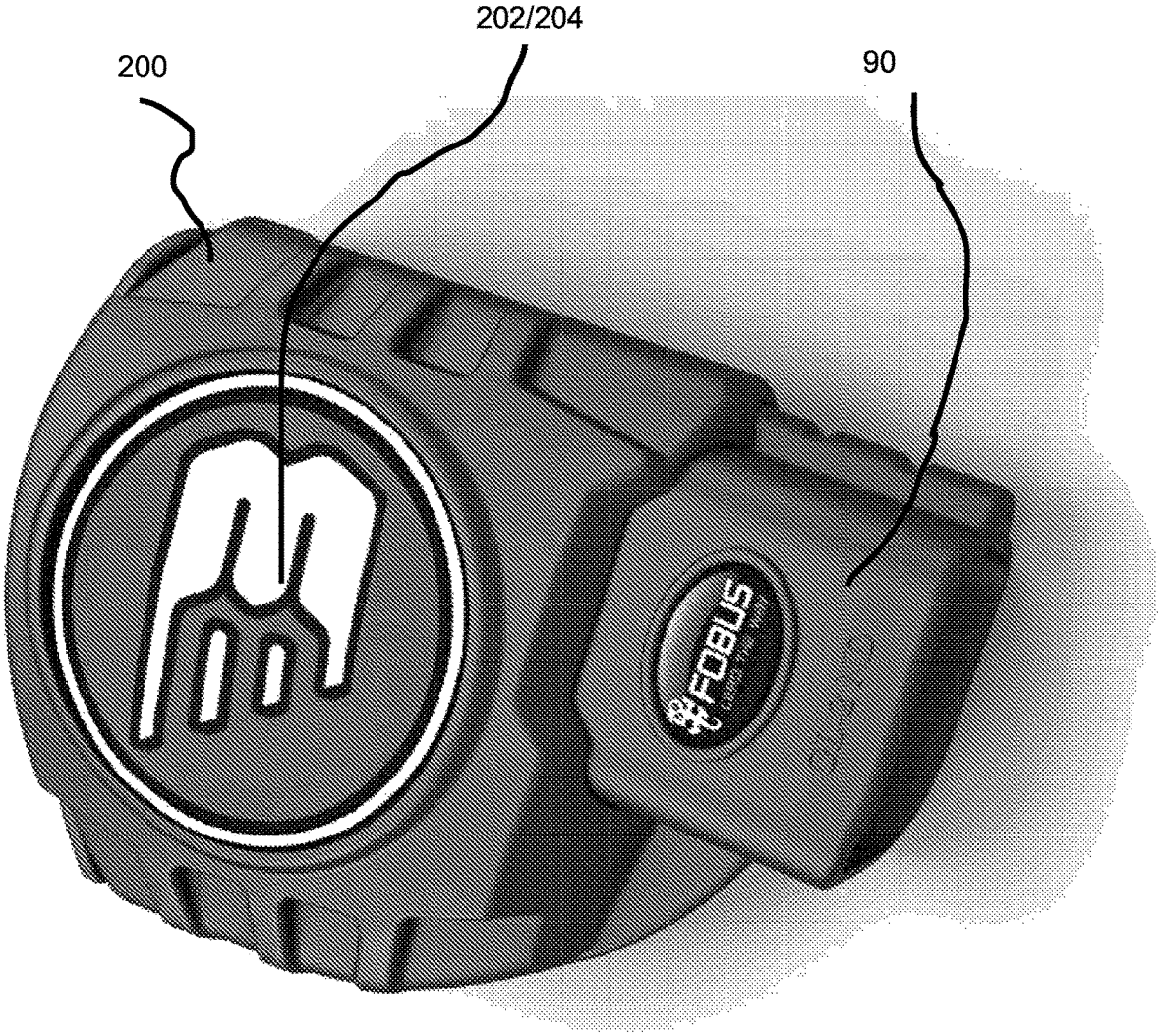
FIG. 10 is a perspective view of the holster identification device shown in FIG. 9, in combination with a prior art holster.
Figure 11:
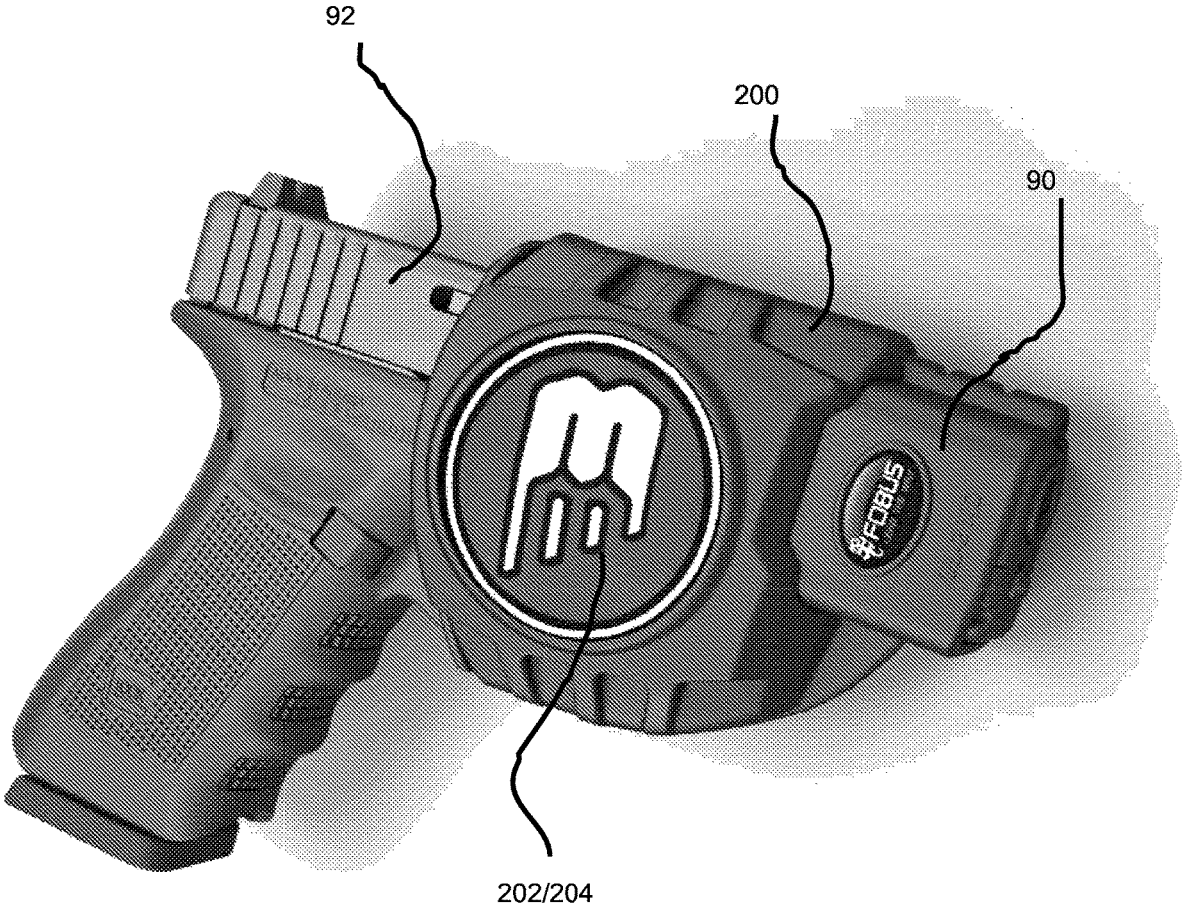
FIG. 11 is a perspective view of the holster identification device and holster shown in FIG. 10, with a prior art firearm in the holster.
Figure 12:
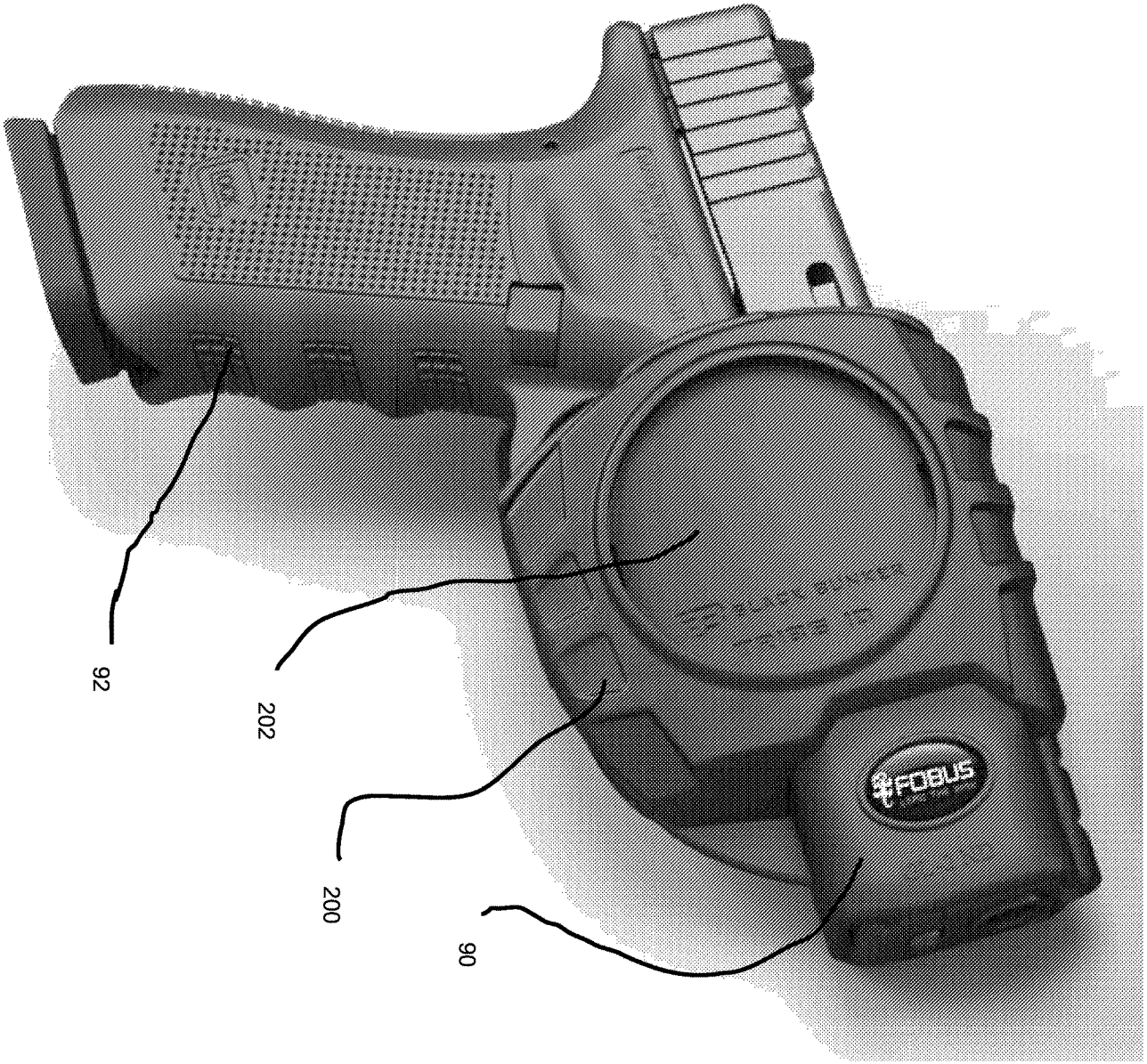
FIG. 12 is a perspective view of a holster identification device according to one embodiment of the present disclosure, in combination with a prior art holster with a prior art firearm therein.
Figure 15C:
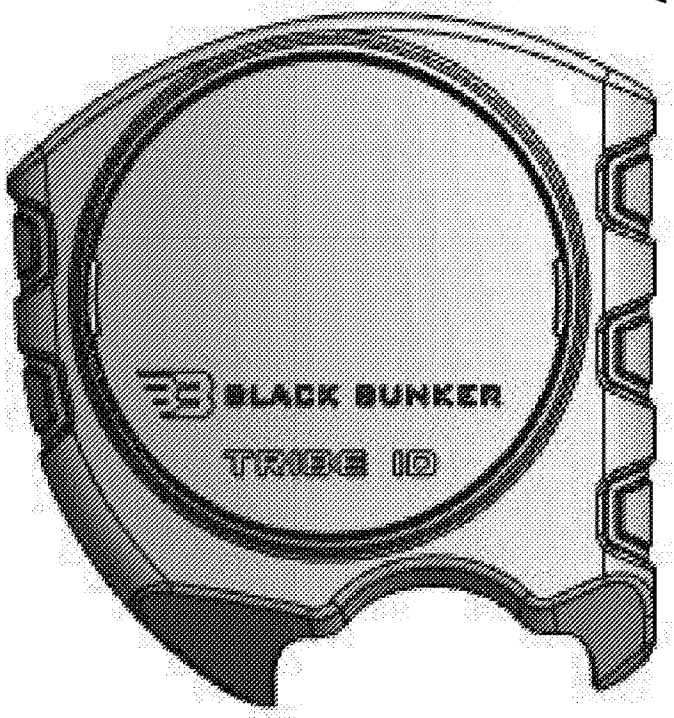
Figure 13C:
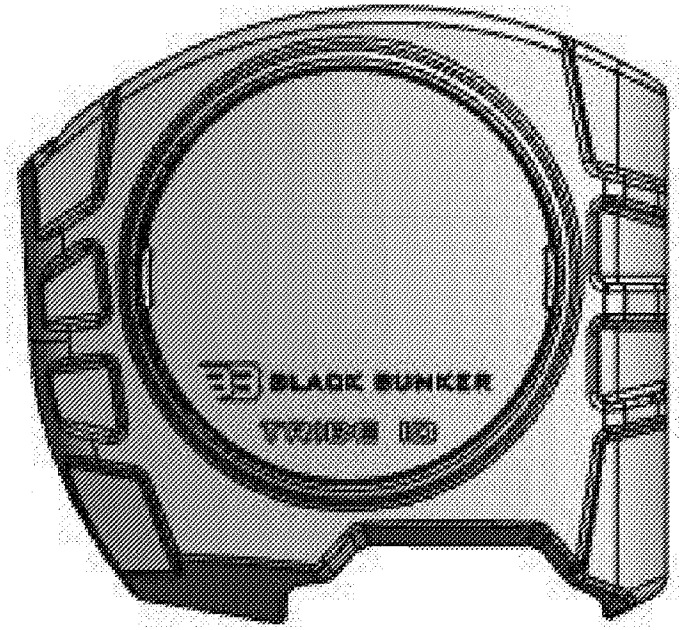
Figure 13D:
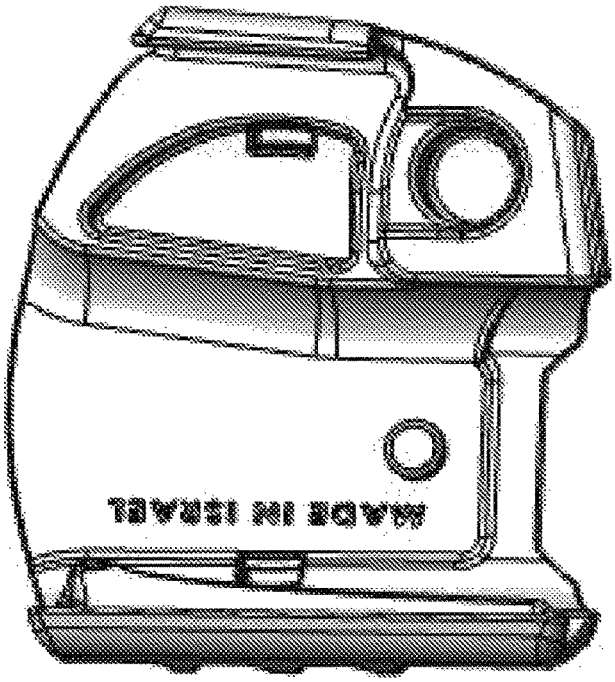
Figure 15D:
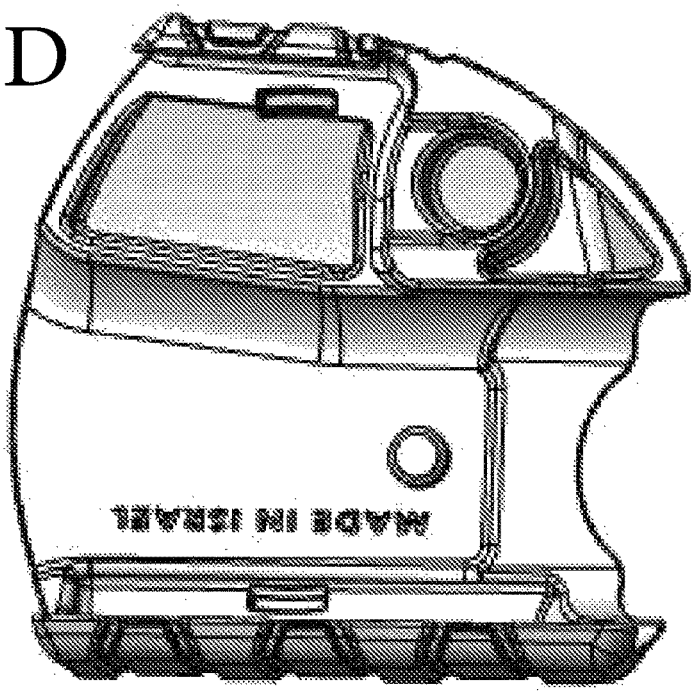
Figure 15E:
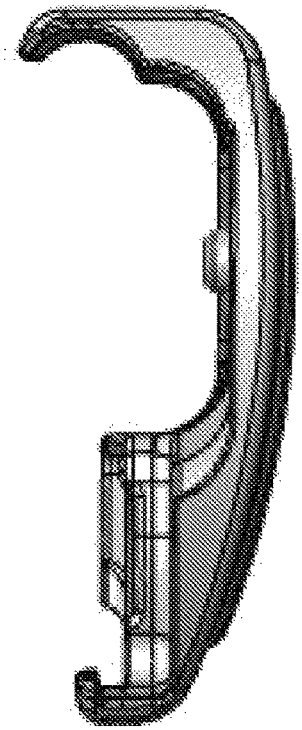
Figure 13E:
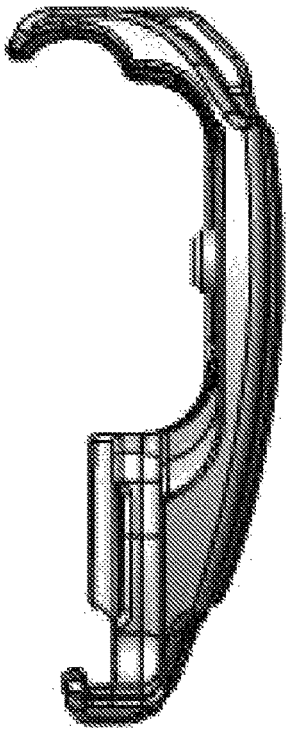
Figure 15F:
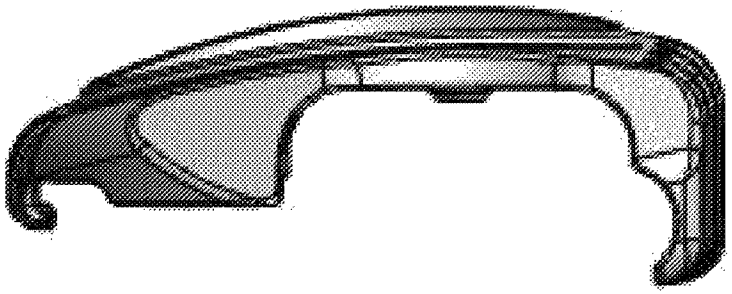
Figure 13F:
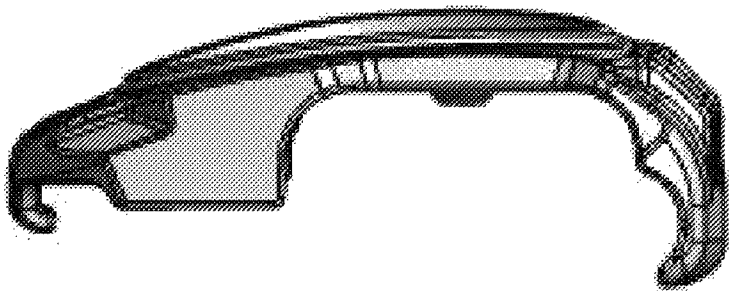
Figure 13G:
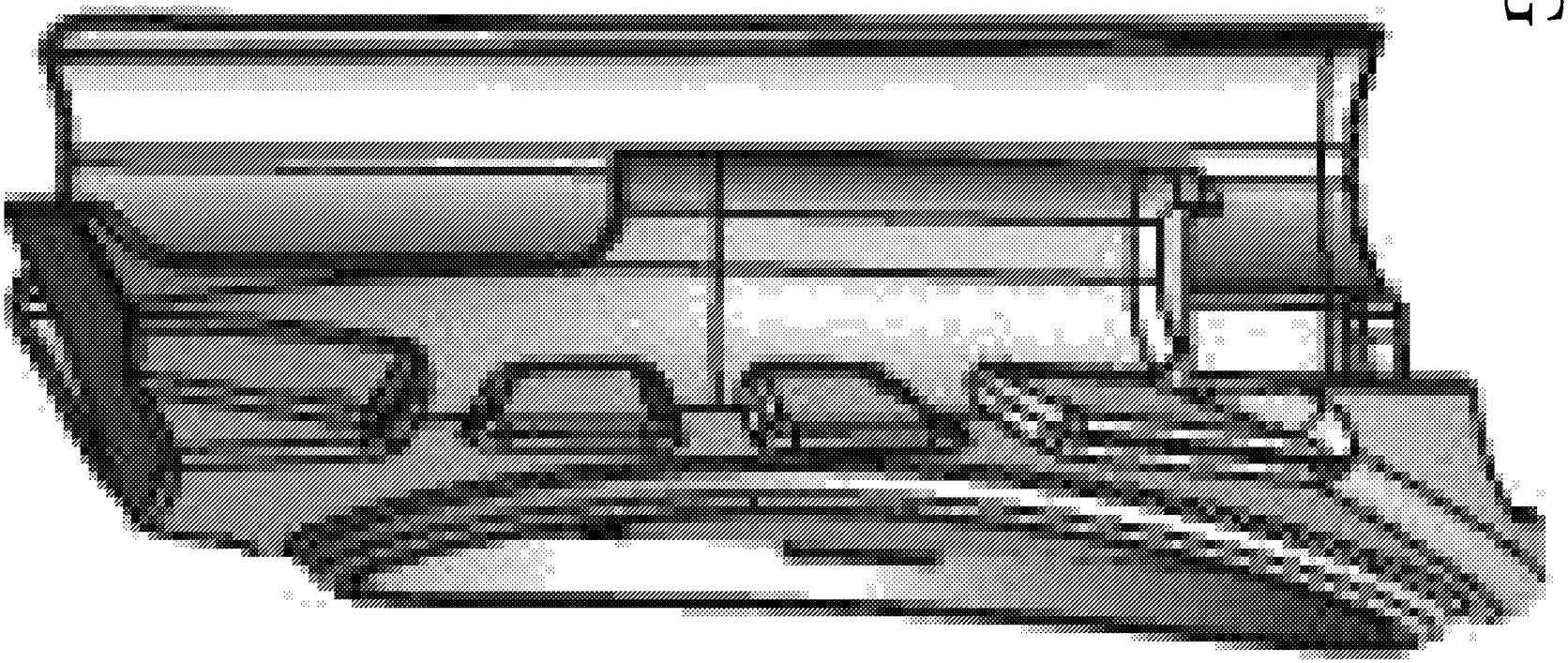
Figure 13H:
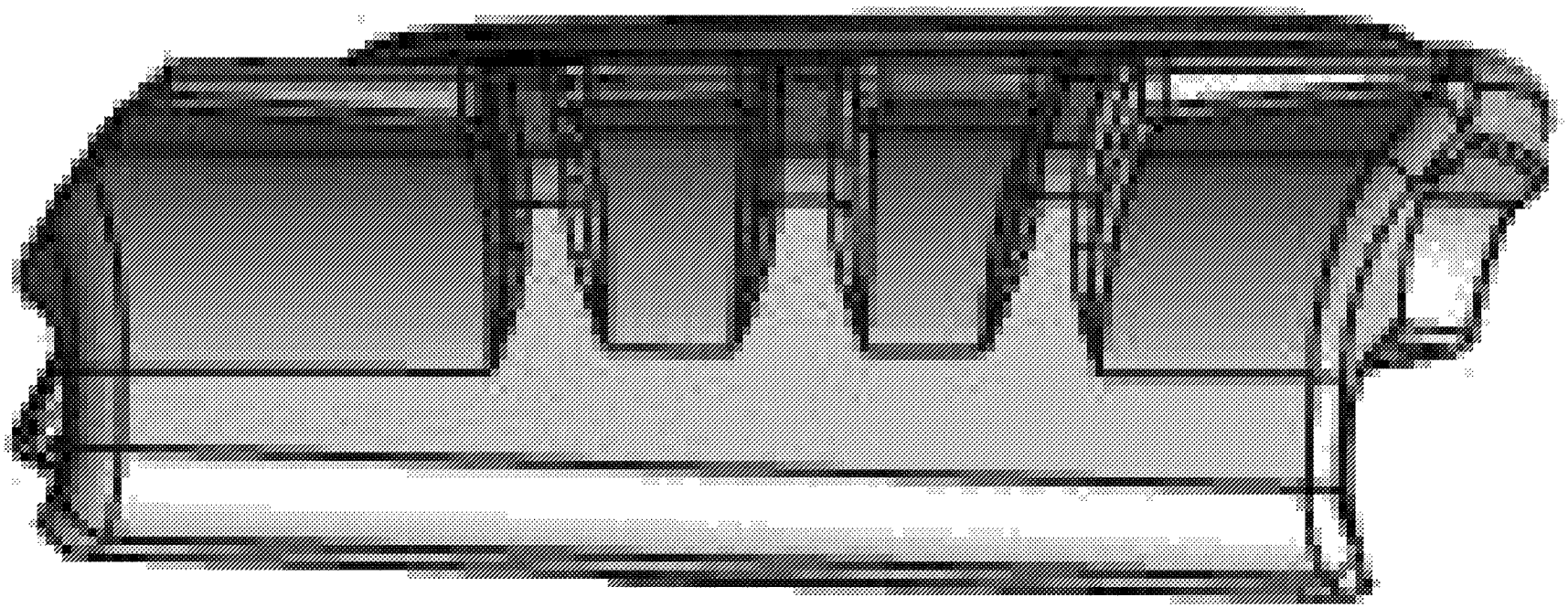

FIG. 9 shows a holster identification device 200 that can be similar to or the same as the holster identification device 100. FIG. 9 is an exploded view, with a body 201 of the device 200 separated from the identification 204, which can be, for example, a badge. The identification 204 can include indicia such as, for example, an owner's name, indicia identifying the owner as a member of a police or military unit, and similarly useful indicia, and/or can be decorative in nature. FIG. 10 shows the holster identification device 200 attached to the holster 90, while FIG. 11 shows a firearm 92 placed in the holster 90 with the holster identification device 200 attached thereto. While in some embodiments the identification 204 can be permanently attached to the holster identification device 200, such as using, for example, an adhesive, in the embodiment shown it is removably attached. This can be achieved using fasteners such as, for example, hook and loop fasteners, non-permanent adhesives, and the like. For instance, in one embodiment the first part of a hook and loop fastener is included in the identification area 202, while the other part of the hook and loop fastener is included on the backside of the identification 204. FIGS. 10 and 11 show the device 200 with identification 204 in the identification area 202. By making the identification 204 removably attachable instead of permanently attached, a user can remove the identifying indicia (e.g., identifying the owner as a police officer) when that indicia may not be desired.

In the specific embodiment shown in FIGS. 9-11, the holster 90 is a GL-2 ND holster available from Fobus, which is designed to hold and shown as holding a handgun from Glock. It is understood that holster identification devices according to the present disclosure can be designed to fit many different holsters, and can be part of assemblies including different types of weapons, including but not limited to handguns. Further, identification devices according to the present disclosure can be used in conjunction with holsters and similar devices designed to hold devices other than weapons.

Figures 14A, 16A:
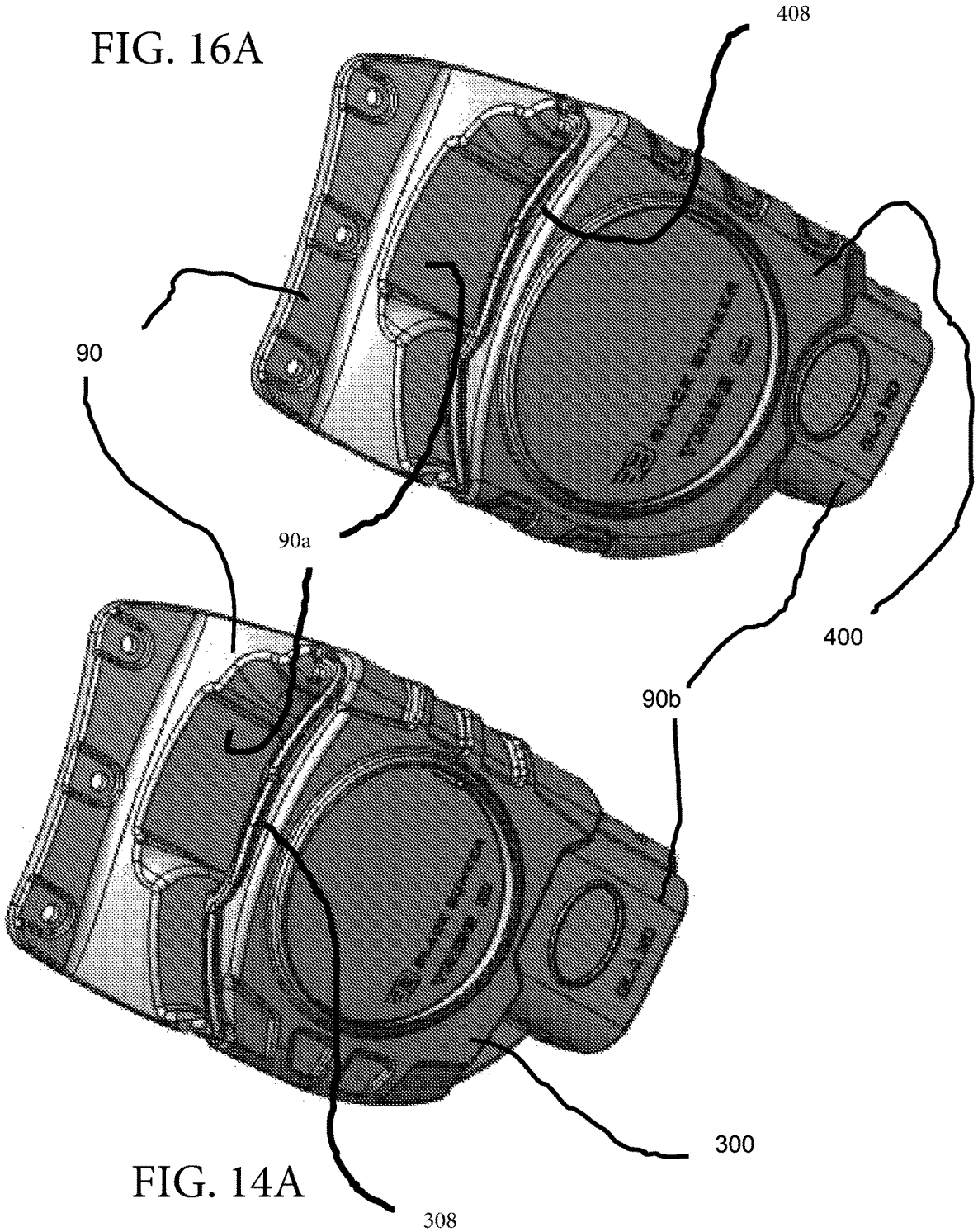
Figure 15G:
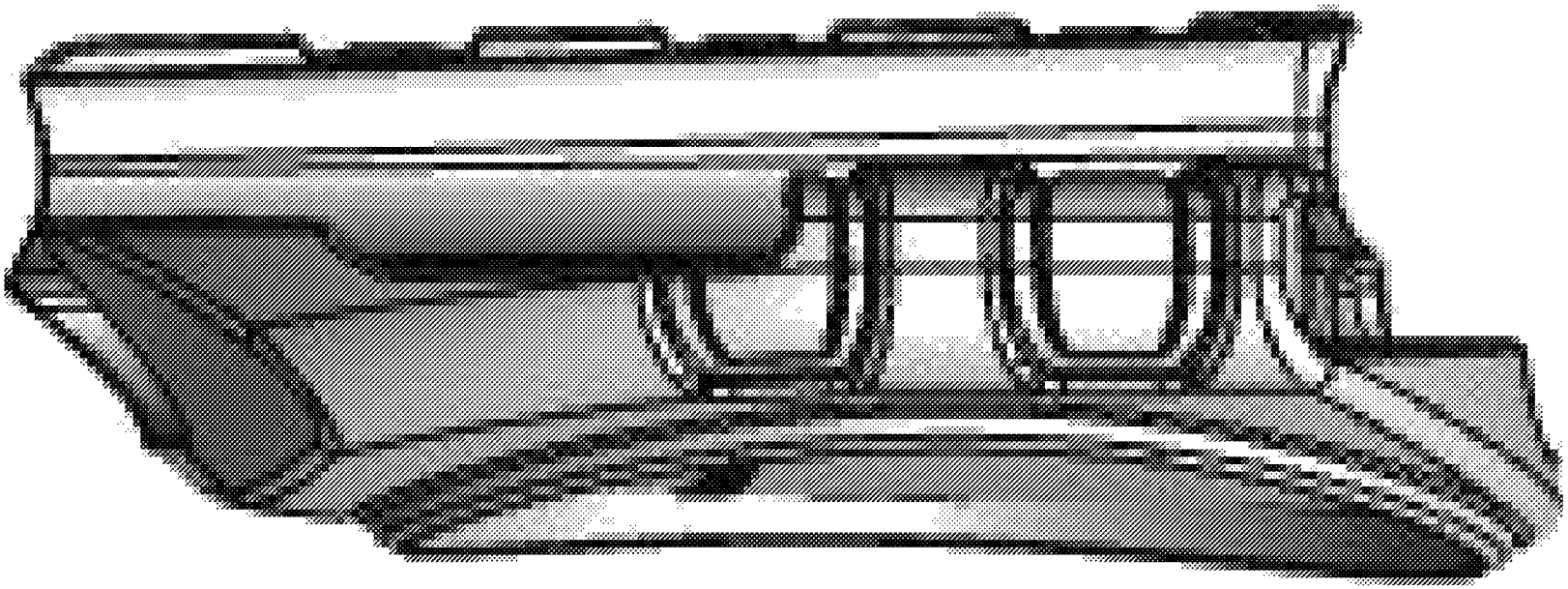
Figure 15H:
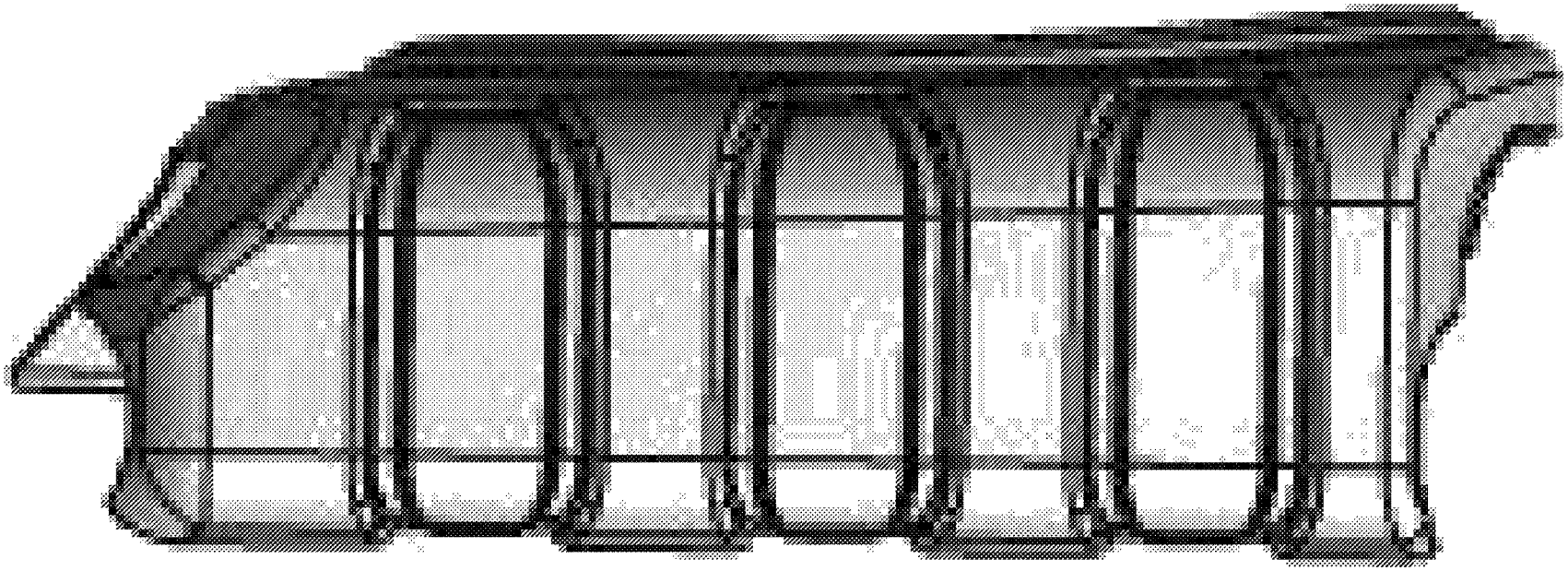

Holster identification devices according to the present disclosure can be designed for attachment to holsters. This attachment can be, for example, a snap-on attachment, an attachment using fasteners, another attachment method, or a combination of methods. FIGS. 13A-13H and 15A-15H show two embodiments of holster identification devices 300, 400, respectively, with FIGS. 14A and 14B showing the device 300 in combination with the holster 90 and FIGS. 16A and 16B showing the device 400 in combination with the holster 90. The device 300 can be the same as or similar to the devices 100, 200, and the device 400 can include many of the same functionalities and components as the devices 100, 200, 300.

The rear, top, bottom, and sides of devices according to the present disclosure can be designed for attachment to a holster, such as a snap-fit attachment, such that the holster identification device is secure with the holster to which it is attached. Devices such as the devices 300, 400 can be designed to include portions and/or sides 304, 404 similar to the portions/sides 104 that wrap around the front, sides, and/or part of the rear of the host holster, and/or hook around sides or portions of the host holster, as shown in the figures, to achieve the attachment (e.g. snap-fit) necessary to secure the device. Other embodiments where the identification device wraps around the entire holster are also possible.

The portions and/or sides 304, 404 can be made of the same material as the remaining body, or can be made of a different material, with exemplary materials discussed below. The portions/sides can be thin enough so as to be flexible, such that a user can flex them outward (such as by pressing them against the holster to which they are to be attached) until they snap fit onto the host holster. For instance, the sides can be 1/64" or thicker, 1/32" or thicker, 1/16" or thicker, 1/8" or thicker, 1/4" or thicker, 1/2" or thicker, 3/4" or thinner, 1/2" or thinner, 1/3" or thinner, 1/4" or thinner, or 1/8" or thinner. The portions/sides can be between 1/64" and thick, 1/32" and 1/2" thick, and 1/16" to 1/4" thick. Many different embodiments are possible, and it is understood that these ranges are exemplary in nature.

As shown, devices according to the present disclosure can be designed such that the end of a holster protrudes through and below the device, and/or can be designed such that the top of the device is approximately even with a top edge of the holster and/or the holster's weapon carrying portion. For instance, as can be seen in FIGS. 14A and 14B, and in FIGS. 16A and 16B, the tops 308, 408 of the devices 300, 400 are approximately even with the top of the weapon aperture 90*a* of the holster 90. The barrel portion 90*b* of the holster can protrude below the holster identification device placed on it.

The device and host holster can include various protrusion/indentation or male/female combinations such that they properly mate with one another. Particularly, the backside of the device (including portions designed to mate with the front, side(s), and/or rear of the holster) and the holster can include such connections.

The sides of devices according to the present disclosure can be designed to wrap around at last part of the side of the holster and then wrap inward, so as to secure the device onto the holster. The device can be made of a material that is at least slightly flexible, to enable flex that can allow for this type of snap-fit. For example, the device can be made of metal, composite material, polypropylene (and/or other polymers), plastic, other materials as known in the art, and/or combinations thereof.

It is understood that various attributes and elements of from any one embodiment can also be included in other embodiments. Although the present disclosure has been described in detail with reference to certain preferred configurations thereof, other versions are possible. The actual scope of the disclosure encompasses not only the disclosed embodiments, but also all equivalent ways of practicing or implementing the disclosure. The above detailed description of the embodiments of the disclosure is not intended to be exhaustive or to limit the disclosure to the precise form disclosed above or to the particular field of usage mentioned in this disclosure. While specific embodiments of, and examples for, the disclosure are described above for illustrative purposes, various equivalent modifications are possible within the scope of the disclosure, as those skilled in the relevant art will recognize. The elements and acts of the various embodiments described above may be combined to provide further embodiments. Further, the teachings of the disclosure provided herein may be applied to products and systems other than handgun holsters, including but not limited to holsters of other types.

We claim:

1. A holster arrangement comprising a holster body and a holster identification device snap-fit onto said holster body using two side portions of the holster identification device that wrap around at least a portion of said holster body, wherein a barrel portion of the holster body protrudes below said holster identification device, and wherein a frontside of said holster body and a backside of said holster identification device collectively comprise a plurality of protrusion/indentation combinations such that they properly mate with one another.

2. The holster arrangement of claim 1, wherein a top of said holster identification device is approximately even with a top of an aperture of said holster.

* * * * *